US008397442B2

(12) United States Patent
Laurin

(10) Patent No.: US 8,397,442 B2
(45) Date of Patent: Mar. 19, 2013

(54) SURFACE AND INGROUND ADJUSTABLE STRUCTURAL CONCRETE PIERS

(75) Inventor: Luc Laurin, Gatineau (CA)

(73) Assignee: Renovation S.E.M. Inc., Gatineau, Quebec (CA)

( * ) Notice: Subject to any disclaimer, the term of this patent is extended or adjusted under 35 U.S.C. 154(b) by 240 days.

(21) Appl. No.: 12/803,808

(22) Filed: Jul. 7, 2010

(65) Prior Publication Data

US 2011/0252722 A1 Oct. 20, 2011

(30) Foreign Application Priority Data

Apr. 16, 2010 (CA) ..... 2700707

(51) Int. Cl.
*E04B 9/00* (2006.01)

(52) U.S. Cl. ..... 52/126.6

(58) Field of Classification Search ..... 52/125.4, 52/125.5, 126.1, 126.6, 294, 299, 298, 295; 248/677–679, 354.3, 188.4, 346.06
See application file for complete search history.

(56) References Cited

U.S. PATENT DOCUMENTS 4,404,780 A * 9/1983 Josephson ..... 52/126.7
4,750,306 A * 6/1988 Granieri ..... 52/251
5,516,069 A * 5/1996 Hanna ..... 248/354.3
5,561,950 A 10/1996 Collins et al.
5,749,188 A * 5/1998 Belbenoit ..... 52/263
5,819,482 A * 10/1998 Belke et al. ..... 52/126.6
5,966,882 A * 10/1999 Naito ..... 52/295
6,094,873 A * 8/2000 Hoffman et al. ..... 52/126.6
6,345,474 B1 * 2/2002 Triplett ..... 52/169.9
6,463,704 B1 * 10/2002 Jette ..... 52/125.2
6,536,170 B2 * 3/2003 Stuever ..... 52/299
7,343,713 B2 * 3/2008 Knepp et al. ..... 52/126.1
7,607,264 B2 * 10/2009 Weber ..... 52/169.9
2004/0163334 A1 * 8/2004 Carlson ..... 52/126.6
2005/0056760 A1 * 3/2005 Carlson ..... 248/354.3
2005/0161571 A1 * 7/2005 Wood ..... 248/354.3
2009/0145057 A1 * 6/2009 Tsukada et al. ..... 52/126.6

* cited by examiner

*Primary Examiner* — Joshua J Michener
*Assistant Examiner* — Keith Minter
(74) *Attorney, Agent, or Firm* — James P. Muraff; Neal, Gerber & Eisenberg LLP

(57) ABSTRACT

An adjustable concrete pier includes a concrete block having a central aperture extending from a top surface of the block to a bottom surface of the block. The pier includes a plate disposed at the top end of the concrete block, the plate having a hole aligned with the central aperture. An internal reinforcement framework is affixed to the plate and embedded within the concrete block. The central aperture receives a threaded rod to which is affixed a nut larger than the central aperture. A suitable support member, e.g. flat plate, U-shaped channel, etc., is disposed at the upper end of the rod. The internal reinforcement makes the pier much stronger as the load bears on the plate and internal reinforcement. Because the threaded rod is not embedded within the concrete, it can be replaced. This novel design also permits greater vertical adjustability.

14 Claims, 3 Drawing Sheets

SURFACE AND INGROUND ADJUSTABLE STRUCTURAL CONCRETE PIERS

CROSS-REFERENCE TO RELATED APPLICATIONS

This is the first application filed for the present invention.

TECHNICAL FIELD

The present invention relates generally to concrete piers and, more particularly, to adjustable concrete piers.

BACKGROUND

Concrete piers (or pier blocks) are commonly used to support structures such as dwellings, porches, decks, etc. A long-standing problem with concrete piers is that levelling is difficult during construction. A further problem is that the ground may move or settle over time, for example due to freezing and thawing.

U.S. Pat. No. 5,561,950 (Collins et al.) discloses an adjustable concrete pier that attempts to address this problem. This adjustable pier block is height-adjustable so that a deck, porch, structural beam, etc. can be leveled. This adjustable pier block can be also be re-adjusted if the ground has settled over time. This adjustable concrete pier has a threaded rod embedded into the concrete footing (concrete block). Although the basic idea is meritorious, there a number of shortcomings with this prior-art design. Firstly, the strength of this prior-art adjustable pier block is quite limited because the threaded rod is embedded directly in the concrete. The interface between the concrete and the threads of the threaded rod provides only limited strength. This design is vulnerable to failure, particularly under impact loading. Secondly, the range of adjustability of this prior-art adjustable pier block is limited as the top coupling can only be safely raised a certain amount before the coupling and threaded rod become undone or loose. A third design limitation of this prior-art pier block is that, since the threaded rod is embedded permanently in the concrete pier block, the pier block can only be used with that particular threaded rod. There is no ability to replace the threaded rod.

In view of these shortcomings, an improvement on this prior-art pier block would thus be highly desirable.

SUMMARY

The present invention provides a novel adjustable concrete pier that overcomes the deficiencies identified above with respect to the prior art. This adjustable concrete pier incorporates an internal reinforcement framework to dramatically strengthen the pier. Accordingly, this pier is a adjustable structural pier. The novel adjustable concrete pier has a central aperture into which a threaded rod (having an upper support member) may be inserted. The threaded rod has a nut larger than the central aperture so that the nut abuts the plate surrounding the aperture. The threaded rod (with its upper support member) is thus removable (i.e. replaceable) unlike the prior-art design which permanently embeds the rod in the concrete. Furthermore, the design of the rod and nut permits greater vertical adjustability than the prior-art design.

In accordance with one main aspect of the present invention, an adjustable concrete pier is made of a concrete block having a central aperture extending from a top surface of the block to a bottom surface of the block. A plate is disposed at the top end of the concrete block. The plate has a hole aligned with the central aperture. An internal reinforcement framework is affixed to the plate and embedded within the concrete block. The central aperture is dimensioned to receive a threaded rod on which is threaded a nut. The nut is larger than the central aperture. A support member is disposed at an upper end of the threaded rod.

In accordance with another main aspect of the present invention, a method of adjusting the height of an adjustable concrete pier entails positioning the pier, the pier comprising a concrete block having a central aperture extending from a top surface of the block to a bottom surface of the block, the pier further comprising a plate disposed at the top end of the concrete block, the plate having a hole aligned with the central aperture, the pier further comprising an internal reinforcement framework affixed to the plate and embedded within the concrete block. The method further entails adjusting a nut along a threaded rod having a support member disposed at an upper end of the threaded rod. The method further entails inserting the threaded rod into the central aperture until the nut abuts the plate.

In accordance with yet another main aspect of the present invention, an adjustable concrete pier system includes an adjustable concrete pier having a concrete block having a central aperture extending from a top surface of the block to a bottom surface of the block, a plate disposed at the top end of the concrete block, the plate having a hole aligned with the central aperture, and an internal reinforcement framework affixed to the plate and embedded within the concrete block. The system also includes an anchoring rod for protruding through the central aperture to anchor the adjustable concrete pier to a concrete slab. The system further includes a vertical extension member having internal threads for connecting to a top portion of the anchoring rod that protrudes above the adjustable concrete pier. The vertical extension member has a top plate with a top hole for receiving a threaded rod having an upper support member that is adapted to support a load.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
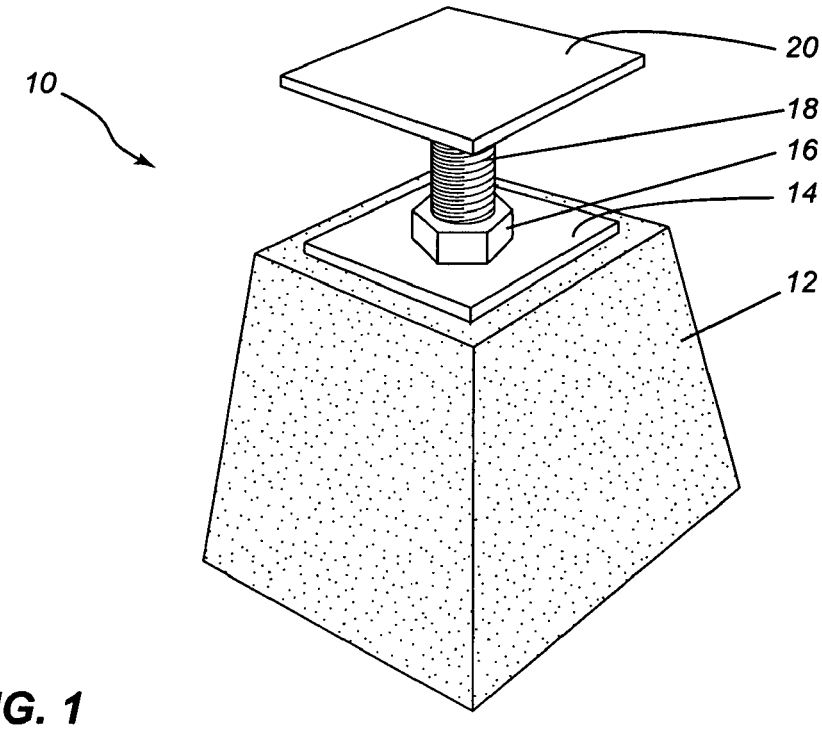
FIG. 1 is a perspective view of an adjustable concrete pier in accordance with an embodiment of the present invention.

In general, the present invention is directed to a novel adjustable concrete pier which is generally designated by reference numeral 10 in the appended figures.

Figure 2:
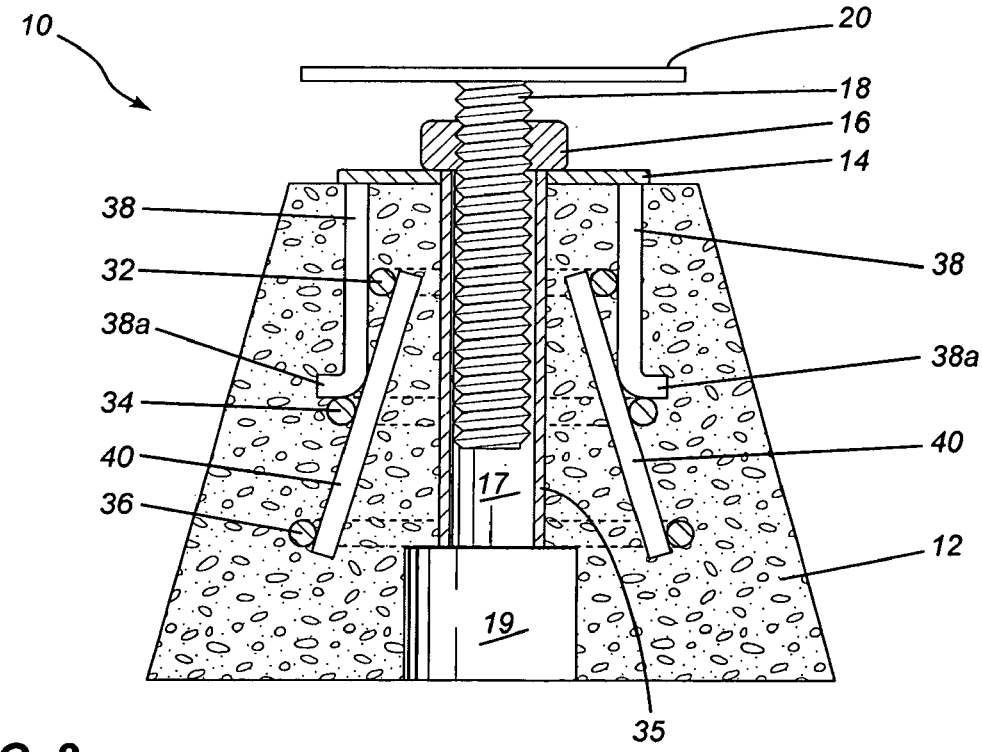
FIG. 2 is a cross-sectional view of the adjustable concrete pier of FIG. 1.

As depicted in FIG. 1, the adjustable concrete pier 10 in accordance with an embodiment of the present invention includes a concrete block 12 (or footing) made of any suitable concrete or cement-based material. The adjustable concrete pier 10 includes a plate 14 connected to an internal reinforcement structure (to be described below in greater detail). The adjustable concrete pier 10 is used in conjunction with a threaded rod 18, a nut 16 and an upper support member 20. The nut 16 is threaded onto the threaded rod 18, as shown in FIG. 1. This nut 16 is larger than the central aperture (as shown in FIG. 2) to prevent the nut from entering the central aperture. This nut 16 thus abuts the plate 18 and supports the threaded rod 18 and its support member 20 (and any load imposed on the support member, such as, for example, a deck, porch or other such structure).

FIG. 2 is a cross-sectional view of the adjustable concrete pier of FIG. 1. As shown in FIG. 2, the adjustable concrete pier 10 includes a central aperture 17 and a counterbore 19. The threaded rod 18 extends into the central aperture 17 (or central bore). The threaded rod 18 may also extend into or even beyond the counterbore 19. For a given rod 18, the length of the rod that extends into the central aperture 17 is regulated by the nut 16. This nut 16 thus permits the vertical adjustment of the rod 18 and of the support member 20 (and of any object supported thereon).

Figure 3:
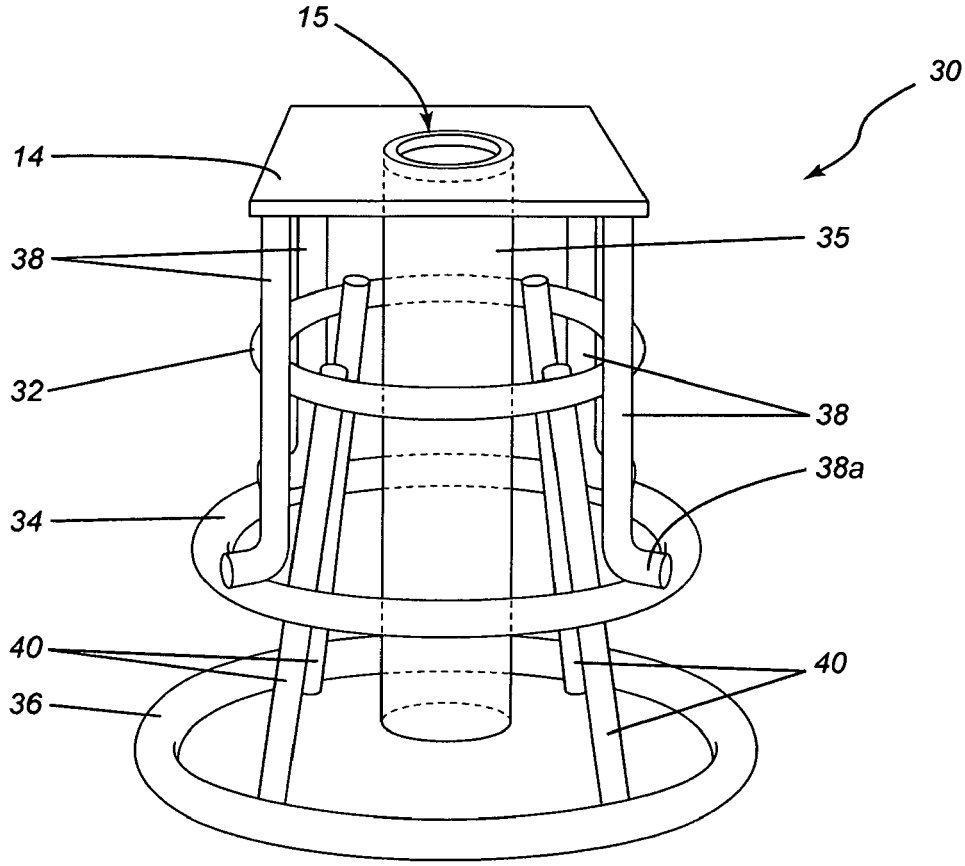
FIG. 3 is a perspective view of the internal reinforcement framework used to reinforce the adjustable concrete pier of FIG. 1.

As depicted in FIG. 3, the adjustable concrete pier 10 has an internal reinforcement framework 30 made of steel rebar or other equivalent material. This internal reinforcement framework is used to reinforce the adjustable concrete pier of FIG. 1. This internal reinforcement framework 30 includes three rings, namely a first ring 32, a second ring 34 and a third ring 36. These three vertically spaced circular steel rings 32, 34, 36 are welded to four straight steel rods 40 as shown by way of example in FIG. 3. In addition, as further depicted in FIG. 3, the internal reinforcement framework 30 is welded to the plate 14 by four L-shaped steel rods 38 each having an elbow or bend 38*a* as depicted in FIG. 3.

FIG. 3 shows that the plate 14 has a central hole 15. This central hole 15 is aligned with the central aperture (central bore) 17, as best illustrated in FIG. 2. As shown in FIG. 3, a sleeve 35 extends downwardly from the underside of the plate 14 in alignment. The sleeve 35 is aligned with the central hole 15 to enable the threaded rod to be inserted through the sleeve 35 and bore 17 as shown. The plate and sleeve are preferably made of steel but may be made of any other equivalent material.

This internal reinforcement framework 30 is embedded in the concrete block as shown in the cross-sectional view presented in FIG. 2. This figure also shows how the L-shaped rods 38 extend from the respective corners of the underside of the plate 14 to the second ring 34. The elbows 38*a* of the L-shaped rods 38 are welded to the top surface of the second ring 34. The L-shaped rods are also welded to the outer periphery of the first ring 32. The straight rods 40 are welded to the inner periphery of each of the three rings 32, 34, 36, as shown in FIG. 2 and FIG. 3.

Figure 4:
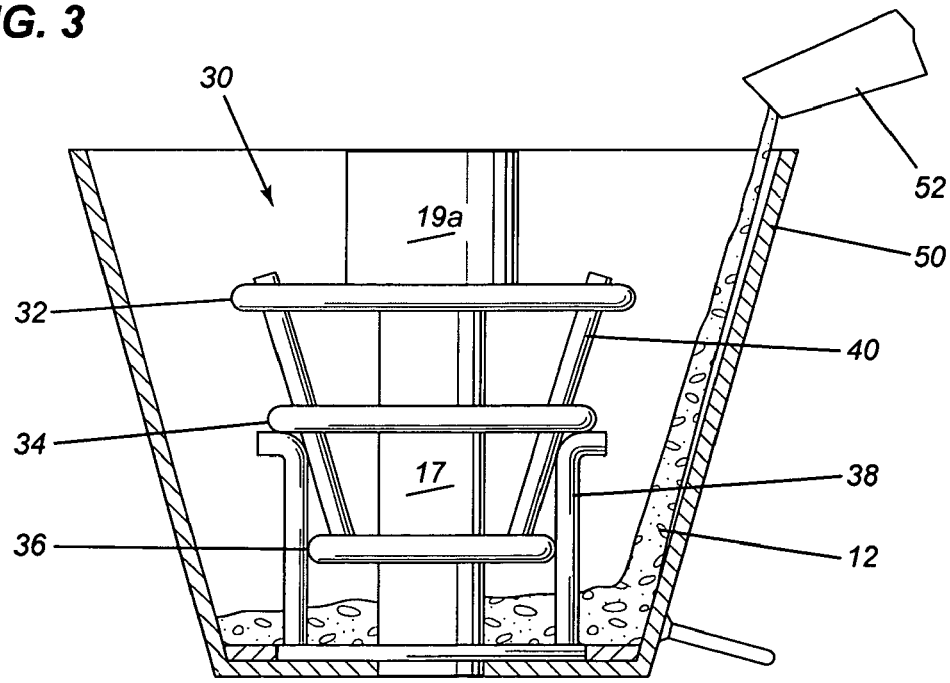
FIG. 4 depicts a method of fabricating the adjustable concrete pier of FIG. 1.

FIG. 4 depicts a method of fabricating the adjustable concrete pier of FIG. 1 using a mould 50. The internal reinforcement framework 30 is inverted and placed inside the mould as shown in FIG. 4. A cylindrical insert or plug 19*a* is inserted into the bottom of the sleeve to create the counterbore 19. With the insert/plug 19*a* in place, concrete from a concrete supply 52 is then poured into the mould 50 and cured. Once the concrete has set, the mould is removed to reveal the adjustable concrete pier depicted in FIG. 1. The insert/plug 19*a* is then removed from the sleeve to reveal the counterbore 19. This insert/plug is removed by impacting the top of the insert/plug through the sleeve.

Figure 5:
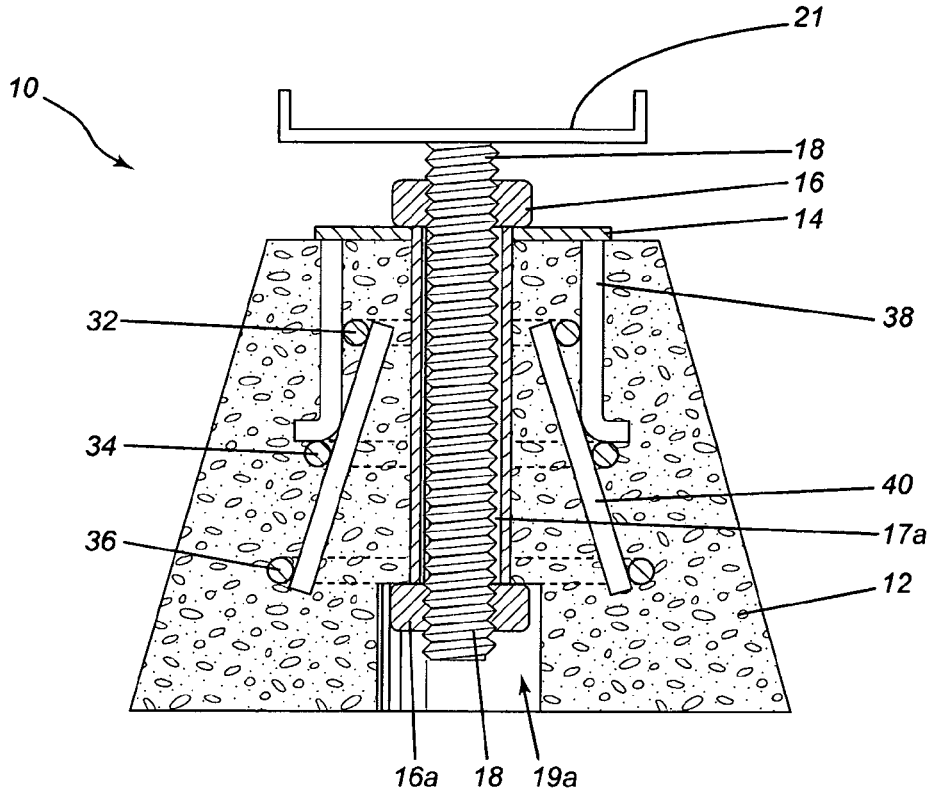
FIG. 5 is a cross-sectional view of an adjustable concrete pier in accordance with another embodiment of the present invention.

FIG. 5 is a cross-sectional view of an adjustable concrete pier 10 in accordance with another embodiment of the present invention. In this further embodiment, the adjustable concrete pier 10 has a longer threaded rod 18 that protrudes into the counterbore 19. A second nut 16*a* is threaded onto the bottom of the threaded rod 18 and tightened against the upper surface of the counterbore, to thereby lock the threaded rod in place.

The adjustable concrete pier may be used as a surface support element or an in-ground support element. In either case, it may optionally be anchored into the ground. This adjustable concrete pier can be used as a structural support for a deck, porch, structural beam or any other building, dwelling, or structure.

In operation, a builder may use the adjustable concrete pier to ensure that a structure is supported at the desired height, either during construction as an initial levelling or after construction, i.e. readjusting the level of the structure to compensate for settling of the structure over time. After the pier has been positioned in the correct location, the nut is adjusted along the threaded rod. The threaded rod is then inserted into the central aperture until the nut abuts the plate. Optionally, the threaded rod may be removed and a new threaded rod inserted (after first removing the load from the upper supporting member).

Figure 6:
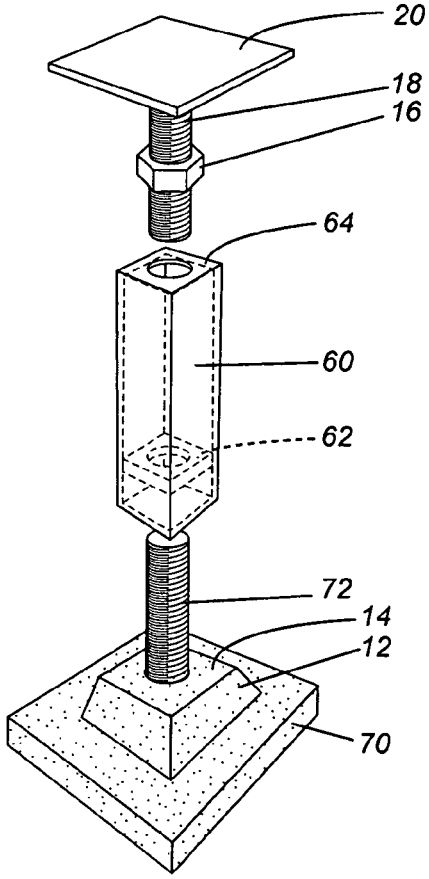
FIG. 6 is a perspective view of an adjustable concrete pier anchored in a concrete slab and having a vertical extension member in accordance with yet another embodiment of the present invention.

FIG. 6 is a perspective view of an adjustable concrete pier anchored in a concrete slab and having a vertical extension member in accordance with yet another embodiment of the present invention. As depicted by way of example in FIG. 6, the adjustable concrete pier may be anchored to a concrete slab 70 (or to a concrete floor, pad or other base) by a threaded anchoring rod 72. This threaded anchoring rod protrudes through the concrete block 12 and plate 14. In the specific example shown in FIG. 6, the threaded anchoring rod protrudes beyond the plate to enable threaded connection between the top portion of the threaded anchoring rod and an internally welded nut 62 that is secured inside a box-beam vertical extension member 60. The vertical extension member may be a tubular member, a rectangular member or any other suitable shape. At the top of this vertical extension member 60 is a top plate 64, analogous to the plate 14 on the adjustable concrete pier. This top plate 64 may also have a circular hole and downwardly extending internal sleeve for receiving a correspondingly sized threaded rod 18 having a nut 16 threaded thereon. Affixed to the threaded rod 18 is an upper support member 20. Once the anchoring rod is cured in the concrete slab, the adjustable concrete pier is installed onto this rod. The internally welded nut of the vertical extension member is then screwed onto the protruding portion of this anchoring rod. Finally, the threaded rod 18 (with its upper support member 20 and nut 16) is inserted into the hole of the top plate 64 until the nut abuts the top plate 64. This vertical extension member permits the adjustable concrete pier to be used for supporting high beams, structures or other loads from the ground. The vertical extension member can be made in any desired length, provided the beam is designed to withstand the buckling load.

The embodiments of the invention described above are intended to be exemplary only. As will be appreciated by those of ordinary skill in the art, to whom this specification is addressed, many obvious variations, modifications, and refinements can be made to the embodiments presented herein without departing from the spirit and scope of the invention. The scope of the exclusive right sought by the applicant is therefore intended to be limited solely by the appended claims.

The invention claimed is:

1. An adjustable concrete pier comprising:

a concrete block having a central aperture extending from a top surface of the block to a bottom surface of the block;

a plate disposed at the top end of the concrete block, the plate having a hole aligned with the central aperture; and an internal reinforcement framework welded to the plate by multiple L-shaped steel rods and embedded within the concrete block, wherein the internal reinforcement framework comprises a plurality of vertically spaced circular steel rings, each having a different diameter, welded to multiple straight steel rods that are inclined relative to the central aperture.

2. The adjustable concrete pier as claimed in claim 1 further comprising:

a threaded rod;

a nut threaded onto the threaded rod, the nut being larger than the central aperture; and a support member disposed at an upper end of the threaded rod.

3. The adjustable concrete pier as claimed in claim 1 wherein the internal reinforcement framework comprises three vertically spaced circular steel rings welded to four straight steel rods.

4. The adjustable concrete pier as claimed in claim 1 wherein the internal reinforcement framework is welded to the plate by four L-shaped steel rods.

5. The adjustable concrete pier as claimed in claim 1 wherein the internal reinforcement framework comprises three vertically spaced circular steel rings welded to four straight steel rods on an inner periphery of each of the rings, and wherein the plate is connected to two of the rings by four L-shaped steel rods.

6. The adjustable concrete pier as claimed in claim 5 wherein the four L-shaped steel rods extend vertically from a respective underside corner of the plate.

7. The adjustable concrete pier as claimed in claim 6 wherein the four L-shaped steel rods are welded to an outer periphery of an upper one of the three rings.

8. The adjustable concrete pier as claimed in claim 7 wherein the four L-shaped steel rods are welded to an upper surface of a middle one of the three rings.

9. The adjustable concrete pier as claimed in claim 1 wherein the concrete block comprises a counterbore accessible from a bottom end of the block.

10. The adjustable concrete pier as claimed in claim 1 further comprising a sleeve affixed to the plate and dimensioned to fit within the central aperture.

11. The adjustable concrete pier as claimed in claim 10 wherein the sleeve extends from the plate to a counterbore.

12. The adjustable concrete pier as claimed in claim 1 wherein the block has a flat underside surface for resting on the ground.

13. A method of adjusting the height of an adjustable concrete pier, the method comprising:

positioning the pier, the pier comprising a concrete block having a central aperture extending from a top surface of the block to a bottom surface of the block, the pier further comprising a plate disposed at the top end of the concrete block, the plate having a hole aligned with the central aperture, the pier further comprising an internal reinforcement framework welded to the plate by multiple L-shaped steel rods and embedded within the concrete block, wherein the internal reinforcement framework comprises a plurality of vertically spaced circular steel rings, each having a different diameter, welded to multiple straight steel rods that are inclined relative to the hole;

adjusting a nut along a threaded rod having a support member disposed at an upper end of the threaded rod; and inserting the threaded rod into the central aperture until the nut abuts the plate.

14. The method as claimed in claim 13 further comprising removing the threaded rod and inserting a new threaded rod.

* * * * *